US005749382A

United States Patent [19]

Tsai

[11] Patent Number: 5,749,382

[45] Date of Patent: May 12, 1998

[54] HAIR CLIP AND ORNAMENTAL PLATE ARRANGEMENT

[76] Inventor: Kai-Mou Tsai, 4/F., No. 1, Lane 135, Tao-Hsiang Rd., Peitou Dist., Taipei City, Taiwan

[21] Appl. No.: 803,513

[22] Filed: Feb. 20, 1997

[51] Int. Cl.[6] ..... A45D 8/12

[52] U.S. Cl. ..... 132/275; 132/278; 132/279

[58] Field of Search ..... 132/275, 273, 132/276, 277, 278, 279; 24/459; D28/39, 40, 41, 42, 43

[56] References Cited

U.S. PATENT DOCUMENTS

| | | | |
|---|---|---|---|
| D. 42,086 | 1/1912 | Lane et al. | 132/279 |
| 662,949 | 12/1900 | Lederer | 132/279 |
| 902,317 | 10/1908 | Nichols | 132/279 |
| 1,020,424 | 3/1912 | Hines | 132/278 |
| 1,023,064 | 4/1912 | Bechtold | 132/278 |
| 1,032,353 | 7/1912 | Machate | 132/278 |
| 1,033,621 | 7/1912 | Sadler | 132/278 |
| 1,148,292 | 7/1915 | Davey | 132/278 |

*Primary Examiner*—John J. Wilson
*Assistant Examiner*—Pedro Philogene
*Attorney, Agent, or Firm*—Morton J. Rosenberg; David I. Klein; Jun Y. Lee

[57] ABSTRACT

A hair clip and ornamental plate arrangement including a hair clip, and an ornamental plate fastened to the hair clip, wherein the hair clip has a fixed end provided with an oblong coupling hole, and a free end; the ornamental plate has a T-shaped retainer rod at one end coupled to the oblong coupling hole of the hair clip, and a bridge at an opposite end adapted for holding down the free end of the hair clip.

7 Claims, 4 Drawing Sheets

HAIR CLIP AND ORNAMENTAL PLATE ARRANGEMENT

BACKGROUND OF THE INVENTION

The present invention relates to a hair clip and ornamental plate arrangement which enables a hair clip and an ornamental plate to be conveniently assembled together.

Hair clips are intensively used by women for fastening the hair. In order to attract consumers, regular hair clips are commonly decorated with ornamental plates. These ornamental plates may be directly molded on hair clips, or separately manufactured and then respectively fastened to individual hair clips by fastening devices. According to conventional methods, when an ornamental plate is fixed to a hair clip, it can no longer be detached from the hair clip for a replacement.

SUMMARY OF THE INVENTION

The present invention provides a hair clip and ornamental plate arrangement which allows the user to replace the ornamental plate when desired. According to one embodiment of the present invention, the hair clip and ornamental plate arrangement comprises a hair clip, and an ornamental plate fastened to the hair clip, wherein the hair clip has a fixed end provided with an oblong coupling hole, and a free end; the ornamental plate has a T-shaped retainer rod at one end coupled to the oblong coupling hole of the hair clip, and a bridge at an opposite end adapted for holding down the free end of the hair clip. As an alternate form of the present invention, the retainer rod of the ornamental plate is made in the shape of a circularly headed rod, and a C-shaped clamp is fastened to the retainer rod of the ornamental plate to secure the hair clip in place. As another alternate form of the present invention, the ornamental plate is provided with a receptacle instead of the aforesaid bridge for holding the free end of the hair clip.

DETAILED DESCRIPTION OF THE PREFERRED EMBODIMENTS

Figure 1:
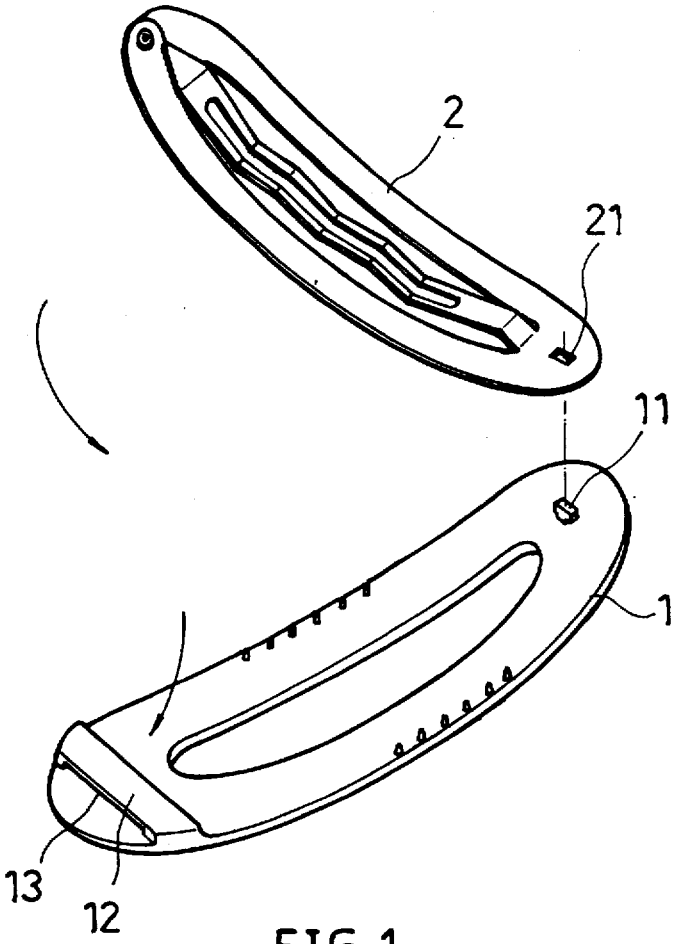
FIG. 1 is an exploded view of a hair clip and ornamental plate arrangement according to a first embodiment of the present invention.
Figure 2:
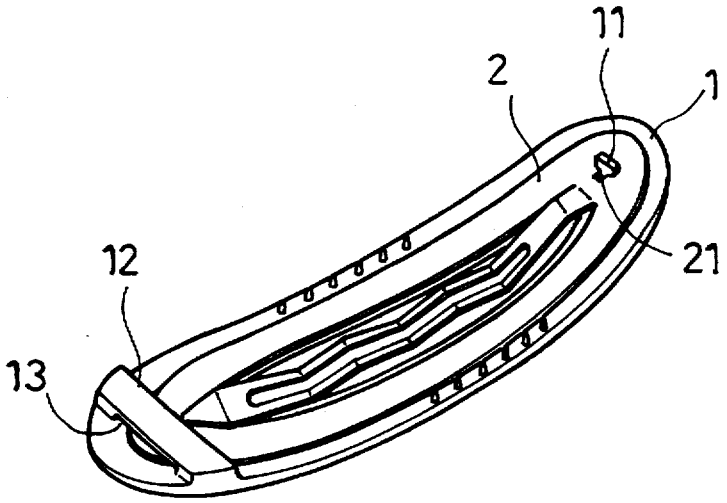
FIG. 2 is an assembly view of the first embodiment shown in FIG. 1.

Referring to FIGS. 1 and 2, a hair clip 2 is secured to an ornamental plate 1. The hair clip 2 has an oblong coupling hole 21 at one end. The ornamental plate 1 is a smoothly arched open frame made from springy material and defining an oblong center opening, having a T-shaped retainer rod 11 raised from one side (the inner side) near one end and a bridge 12 transversely raised from the same side near an opposite end and defining a gap 13. When the oblong coupling hole 21 of the hair clip 2 is coupled to the T-shaped retainer rod 11, the hair clip 2 is turned inwards and closely attached to the inner side of the ornamental plate 1, the opposite end (remote from the oblong coupling hole 21) of the hair clip 2 is inserted into the gap 13, and therefore the hair clip 2 and the ornamental plate 1 are fastened together.

Figure 3:
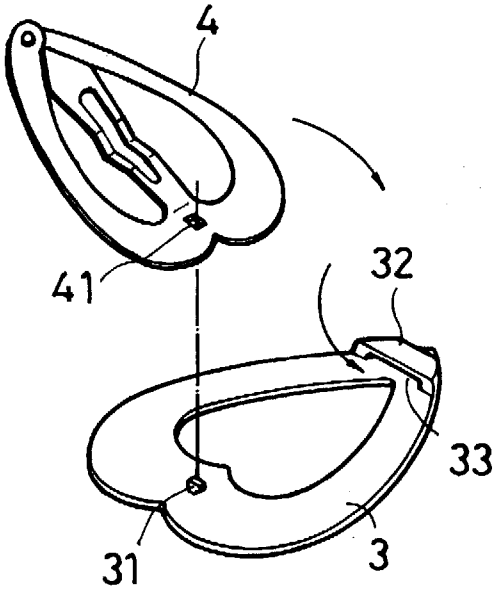
FIG. 3 is an exploded view of a hair clip and ornamental plate arrangement according to a second embodiment of the present invention.

FIG. 3 shows a hair clip and ornamental plate arrangement according to a second embodiment of the present invention. According to this embodiment, the hair clip 4 has a heart-like shape, and an oblong coupling hole 41 at one end; the ornamental plate 3 has a heart-like shape, a T-shaped retainer rod 31 at one end adapted for coupling to the oblong coupling hole 41 of the hair clip 4, and a bridge 32 transversely disposed at an opposite end and defining a gap 33 adapted for receiving the opposite end of the hair clip 4.

Figure 4:
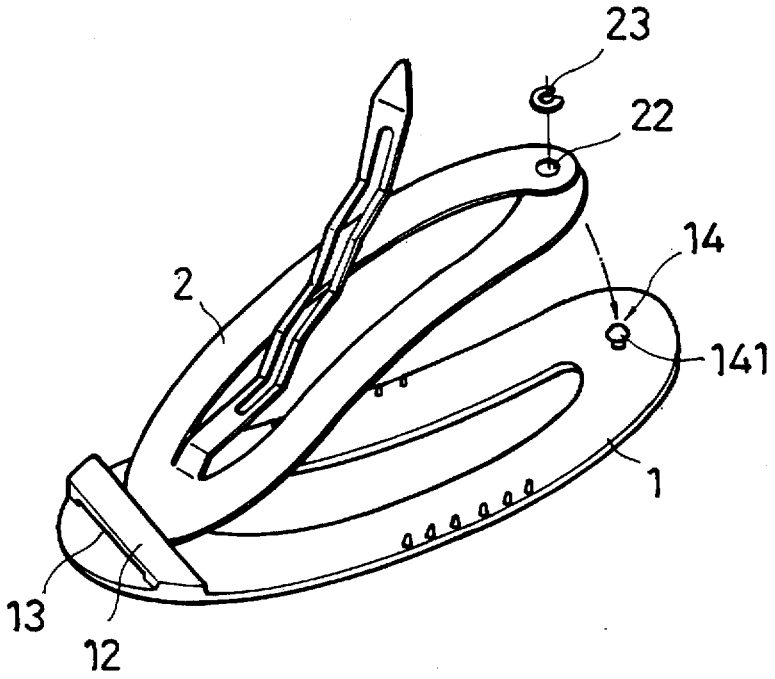
FIG. 4 is an exploded view of a hair clip and ornamental plate arrangement according to a third embodiment of the present invention.
Figure 5:
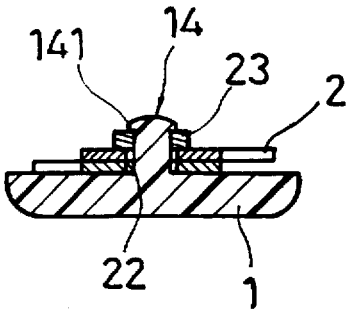
FIG. 5 is a cross sectional view of the third embodiment of shown in FIG. 4, showing the hair clip closed.

FIGS. 4 and 5 show a hair clip and ornamental plate arrangement according to a third embodiment of the present invention. According to this embodiment, the ornamental plate 1 has a retainer rod 14 at one end which has a rounded head 141, and a transverse bridge 12 at an opposite end defining a gap 13 adapted for receiving one end of the hair clip 2; the hair clip 2 has a through hole 22 at one end coupled to the retainer rod 14 of the ornamental plate 1; a C-shaped clamp 23 is fastened to the retainer rod 14 below the rounded head 141 to secure the hair clip 2 in place.

Figure 6:
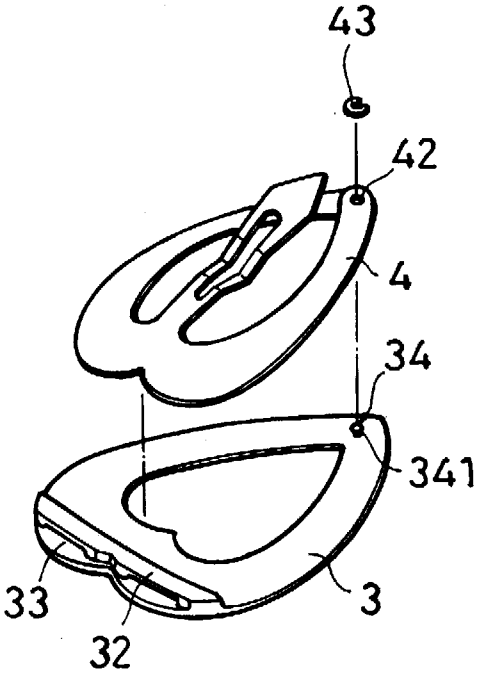
FIG. 6 is an exploded view of a hair clip and ornamental plate arrangement according to a fourth embodiment of the present invention.

FIG. 6 shows a hair clip and ornamental plate arrangement according to a fourth embodiment of the present invention. According to this embodiment, the hair clip 4 has a heart-like shape, and a through hole 42 at one end; the ornamental plate 3 has a heart-like shape, a retainer rod 34 with a rounded head 341 at one end inserted into the through hole 42 of the hair clip 4, and a bridge 32 transversely disposed at an opposite end and defining a gap 33 adapted for receiving the opposite end of the hair clip 4; a C-shaped clamp 43 is fastened to the retainer rod 34 of the ornamental plate 3 below the rounded head 341 to secure the hair clip 4 in place.

Figure 7:
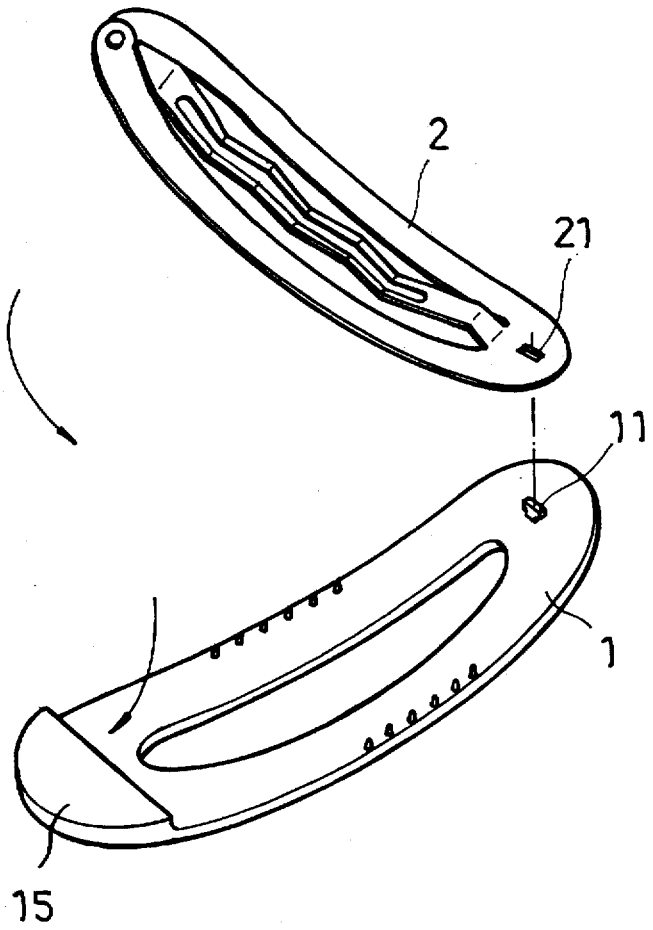
FIG. 7 is an exploded view of a hair clip and ornamental plate arrangement according to a fifth embodiment of the present invention.

FIG. 7 shows a hair clip and ornamental plate arrangement according to a fifth embodiment of the present invention. According to this embodiment, the ornamental plate 1 has a T-shaped retainer rod 11 at one end, and a receptacle 15 at an opposite end adapted for holding one end of the hair clip 2; the hair clip 2 has an oblong coupling hole 21 at one end coupled to the T-shaped retainer rod 11 of the ornamental plate 1.

Figure 8:
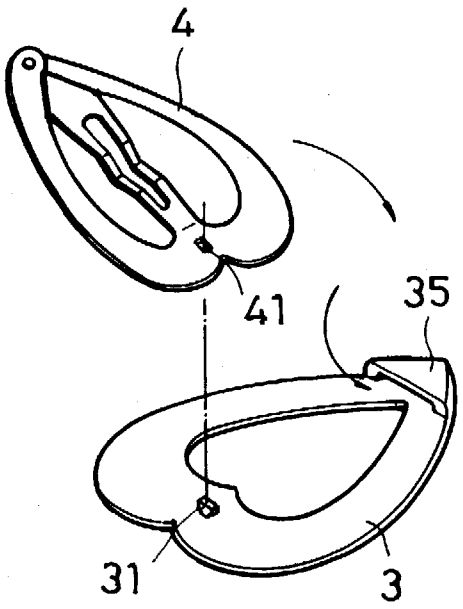
FIG. 8 is an exploded view of a hair clip and ornamental plate arrangement according to a sixth embodiment of the present invention.

FIG. 8 shows a hair clip and ornamental plate arrangement according to a sixth embodiment of the present invention. According to this embodiment, the hair clip 4 has a heart-like shape, and an oblong coupling hole 41 at one end; the ornamental plate 3 has a heart-like shape, a T-shaped retainer rod 31 at one end adapted for coupling to the oblong coupling hole 41 of the hair clip 4, and a receptacle 35 at an opposite end adapted for holding the opposite end of the hair clip 4.

It is to be understood that the drawings are designed for purposes of illustration only, and are not intended as a definition of the limits and scope of the invention disclosed. For example, the retainer rod can have a L-shaped configuration instead of a T-shaped configuration.

What the invention claimed is:

1. A hair clip and ornamental plate arrangement comprising a hair clip and an ornamental plate fastened to said hair clip, wherein said hair clip has a fixed end provided with a coupling hole, and a free end; said ornamental plate has a retainer rod at one end coupled to the coupling hole of said hair clip, and holding means at an opposite end adapted for holding the free end of said hair clip, said holding means being a bridge transversely raised from said ornamental plate at one end and defining a gap for holding the free end of said hair clip.

2. The hair clip and ornamental plate arrangement of claim 1 wherein said hair clip and said ornamental plate have a respective heart-shaped configuration fitting each other.

3. A hair clip and ornamental plate arrangement comprising a hair clip and an ornamental plate fastened to said hair clip, wherein said hair clip has a fixed end provided with a coupling hole, and a free end; said ornamental plate has a retainer rod at one end coupled to the coupling hole of said hair clip, and holding means at an opposite end adapted for holding the free end of said hair clip, said retainer rod having a T-shaped configuration.

4. The hair clip and ornamental plate arrangement of claim 3 wherein said holding means is a receptacle adapted for holding the free end of said hair clip.

5. A hair clip and ornamental plate arrangement comprising:

a. a hair clip having a fixed end provided with a coupling hole and a free end;

b. an ornamental plate fastened to said hair clip, said ornamental plate having a retainer rod at one end coupled to the coupling hole of said hair clip and holding means at an opposite end adapted for holding the free end of said hair clip; and, c. a C-shaped clamp fastened to said retainer rod to secure said hair clip in place.

6. The hair clip and ornamental plate arrangement of claim 5 wherein said hair clip and said ornamental plate have a respective heart-shaped contour fitting each other.

7. The hair clip and ornamental plate arrangement of claim 5 wherein said holding means is a receptacle adapted for holding the free end of said hair clip.

* * * * *